US007396054B2

(12) United States Patent
Carrier

(10) Patent No.: US 7,396,054 B2
(45) Date of Patent: Jul. 8, 2008

(54) SASH LOCKING DEVICE FOR CASEMENT WINDOW

(76) Inventor: Christian Carrier, 375 Gabrielle-Roy, #4, St-Nicholas, Quebec (CA) G7A 3L3

( * ) Notice: Subject to any disclaimer, the term of this patent is extended or adjusted under 35 U.S.C. 154(b) by 167 days.

(21) Appl. No.: 11/206,531

(22) Filed: Aug. 17, 2005

(65) Prior Publication Data

US 2007/0040396 A1 Feb. 22, 2007

(51) Int. Cl.
*E05C 19/02* (2006.01)

(52) U.S. Cl. ..... 292/75; 292/302; 292/340; 49/395

(58) Field of Classification Search ..... 292/340, 292/240, 242, 73, 75, 77, 261, 302; 49/293, 49/376, 395, 420
See application file for complete search history.

(56) References Cited

U.S. PATENT DOCUMENTS 1,210,535 A * 1/1917 Riley ..... 49/469
1,477,248 A * 12/1923 Daugherty ..... 49/415
2,504,367 A * 4/1950 Willink ..... 292/278
3,239,261 A * 3/1966 Knox et al. ..... 292/75
4,610,472 A * 9/1986 Billingsley ..... 292/54
6,698,970 B2 * 3/2004 Guillemet et al. ..... 403/373

* cited by examiner

*Primary Examiner*—Gary Estremsky
(74) *Attorney, Agent, or Firm*—Eric Fincham

(57) ABSTRACT

An adaptor for a window locking mechanism wherein the locking mechanism includes a keeper on a window sash and a cam roller on a window frame, the adaptor comprising a body portion having first and second sides with a recess being formed in the body portion, the recess being sized to receive a portion of the cam roller, the body portion further having at least one ramped portion extending from an edge of the recess to the first side. The adaptor can be used with conventional cam roller windows and provides an improved surface engagement and a greater displacement span.

10 Claims, 5 Drawing Sheets

SASH LOCKING DEVICE FOR CASEMENT WINDOW

FIELD OF THE INVENTION

The present invention relates to window assemblies and more particularly, relates to an adaptor for use with a window locking mechanism.

BACKGROUND OF THE INVENTION

Window sashes are mounted in window frames and the window sashes either slide, rotate or pivot in the window frame between open and closed positions as well as positions therebetween. The windows are opened and closed by various handles and sash bars. However, once the window is closed or is in proximity to the window frame, a locking device is generally provided to lock the sash in the closed position.

A desired arrangement is the use of multipoint locking mechanisms wherein a slider bar is moved to lock keepers on the window sash with a cam roller on the window frame. The advantage of multipoint locking is to provide a secure locking as well as to provide even pressure on the window. Thus, a multipoint locking mechanism tends to prevent warping of the window sash as it maintains flush with the window frame and the weather stripping to assure a good seal. Even if the sash is warped, this multipoint locking mechanism will exert a force on the sash to straighten the sash in the window frame.

It is known in the art to provide multipoint locking wherein the window lock has ramped keepers secured to the window sash and cam rollers on the slider bar which is amounted to the window frame. The slider bar translates up and down on a side wall of the window frame in response to movement of a handle. In placing the handle in the locking position, the cam rollers on the sliding bar each engage a ramped portion of a ramped keeper so as to lock the window sash to the window frame. A problem with the above arrangement is that the window sash must be generally closed for the rollers to engage the ramped keepers.

In order to overcome the above, it has been proposed in U.S. Pat. No. 6,698,970 to utilize an arrangement wherein both the keeper and the cam are wedges which provide increased surface engagement and a greater displacement span.

While the above has been found to be effective, there still exists many windows which use cam rollers and which windows are frequently difficult to lock.

SUMMARY OF THE INVENTION

It is an object of the present invention to provide an adaptor for window locking mechanisms using cammed rollers.

According to one aspect of the present invention, there is provided an adaptor for a window locking mechanism wherein the locking mechanism comprises a keeper on a window sash and a cam roller on a window frame, the adaptor comprising a body portion having first and second sides, a recess formed in the body portion, the recess being sized to receive a portion of the cam roller, the body portion having at least one ramped portion extending from an edge of the recess to said first side.

In a further aspect of the present invention, in a window having a window locking mechanism comprising a keeper on the window sash and a cam roller on the window frame, there is provided the improvement of an adaptor for the cam roller, the adaptor comprising a body, a recess formed in the body, the recess being sized to partially receive the cam roller with a portion of the cam roller extending outwardly from the recess, the body having at least one ramped portion obliquely positioned with respect to a translation direction of the slider.

The adaptor of the present invention, as previously mentioned, provides a greater displacement span for the locking mechanism. Furthermore, it can be utilized with presently existing windows having cam rollers.

The adaptor may be formed of any suitable material including a plastic or a metallic material with a molded plastic material being the preferred option.

As aforementioned, the adaptor is provided with a ramped surface and preferably, this ramped surface is concave to initially supply a very light closing action and which will later increase. The ramped portion preferably extends to proximate the center point of the cam roller.

BRIEF DESCRIPTION OF THE DRAWINGS

Having thus generally described the invention, reference will be made to the accompanying drawings illustrating an embodiment thereof, in which.

DETAILED DESCRIPTION OF THE INVENTION

Figure 1:
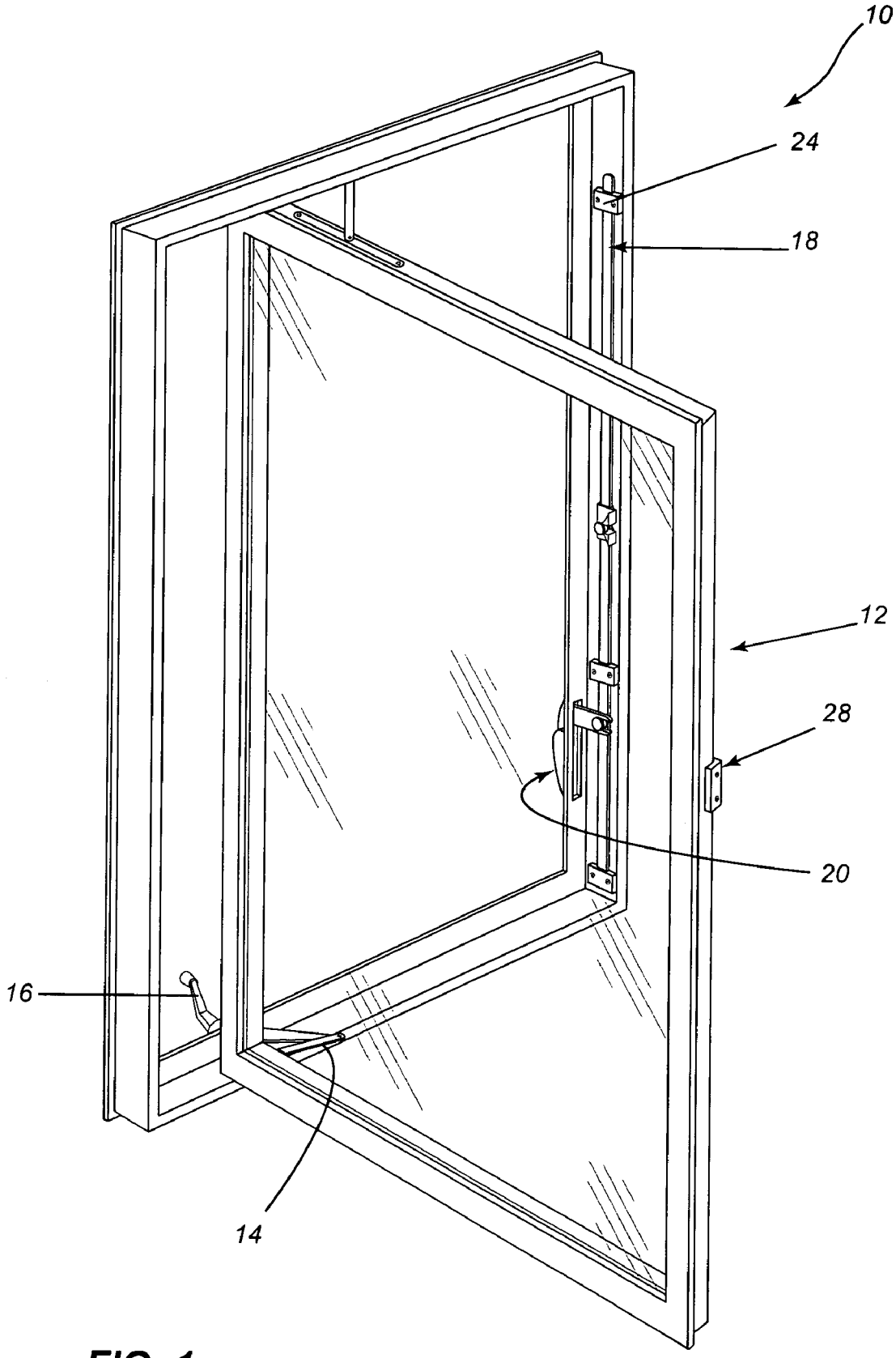
FIG. 1 is a perspective view of a window frame and window sash.
Figure 2:
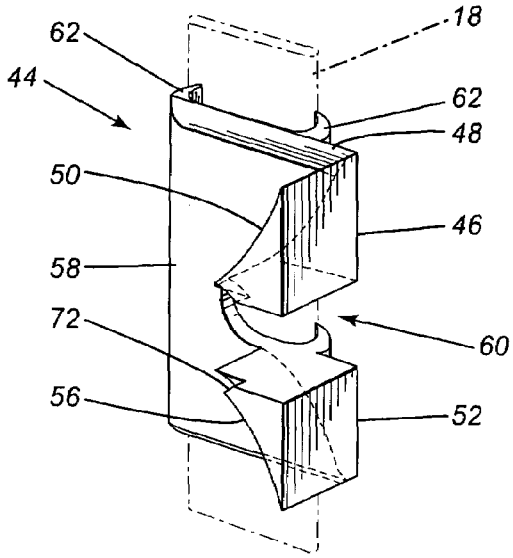
FIG. 2 is a perspective view of an adaptor according to the present invention.
Figure 3:
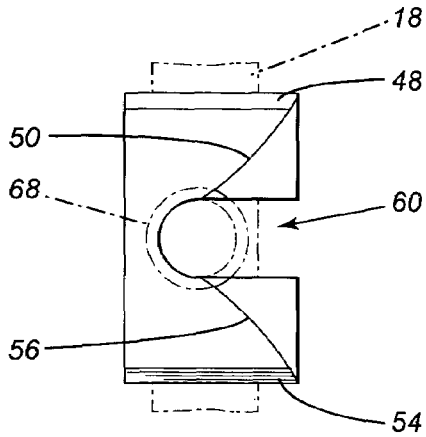
FIG. 3 is a top plan view thereof.
Figure 4:
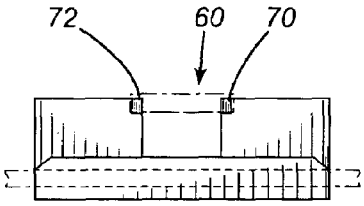
FIG. 4 is a front elevational view thereof.
Figure 5:
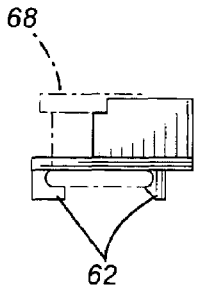
FIG. 5 is an end elevational view thereof.
Figure 6:
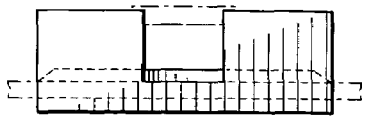
FIG. 6 is a rear elevational view thereof.
Figure 7:
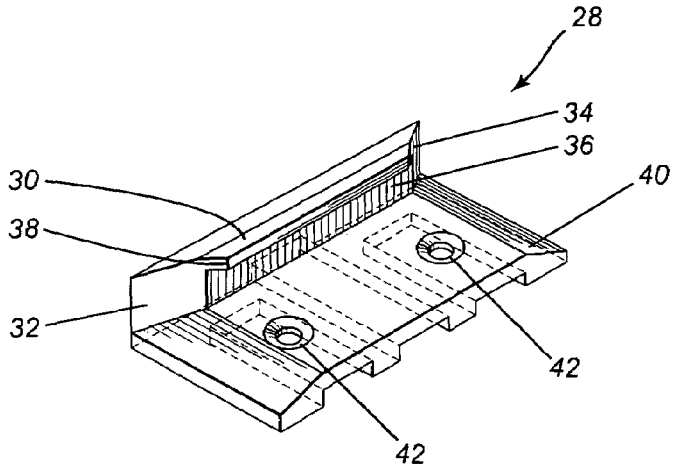
FIG. 7 is perspective view of a keeper which is mounted on the window sash.
Figure 8:
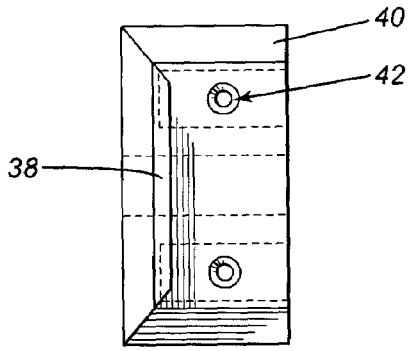
FIG. 8 is a top plan view thereof.
Figure 9:
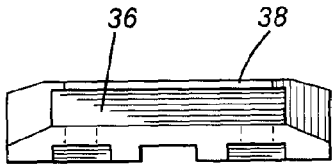
FIG. 9 is a front elevational view thereof.
Figure 10:
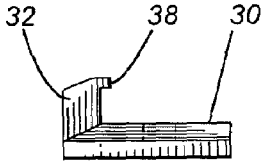
FIG. 10 is an end elevational view thereof.
Figure 11:
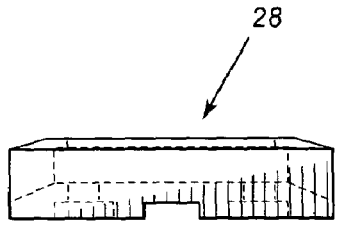
FIG. 11 is a rear elevational view thereof.

Referring to the drawings in greater detail and by reference characters thereto, there is illustrated in FIG. 1 a window frame which is generally designated by reference numeral 10 and which has a window sash generally designated by reference numeral 12.

In the illustrated embodiment, window sash 12 is opened and closed by means of conventional operating levers 14 connected to a rotatable handle 16. The arrangement is well known in the art.

The window frame is provided with a locking handle which is operatively connected to a pivot bar 22 for moving a slider 18. Slider 18 is maintained in position by means of retainers 24. Mounted on slider 18 is a cam roller 26. It will be understood that, for purposes of illustration only, a single cam roller 26 is illustrated while in practice, two or more cam rollers would normally be utilized.

Mounted on window sash 12 are one or more keepers 28, there being one keeper 28 for each cam roller 26. Keeper 28 has a trapezoidal body 30 with a pair of ramped portions 32, 34 on each side thereof. There is also a flat rest portion 36 with a lip 38 extending outwardly at the top of flat rest portion 36. A flange 40 includes apertures 42 for mounting of the keeper to the window sash.

An adaptor according to the present invention is illustrated in FIGS. 2 to 6 and reference will now be had thereto. Adaptor 44 has a first body section 46 which starts at a first side 48 and includes a concave ramped wall portion 50. A second body section 52 likewise starts at a second side 54 and a concave ramped wall portion 56. A flange 58 connects the first body section 46 and second body section 52 with a slot 60 being formed therebetween. On the underside of flange 58 there is provided a pair of clamps 62 such that flange 58 may be mounted on slider 18.

Cam roller 26, as may be seen, has a cylindrical body with an enlarged head portion 68. In order to accommodate enlarged head portion 68, notches 70, 72 are formed in body sections 46 and 52 respectively.

Figure 12:
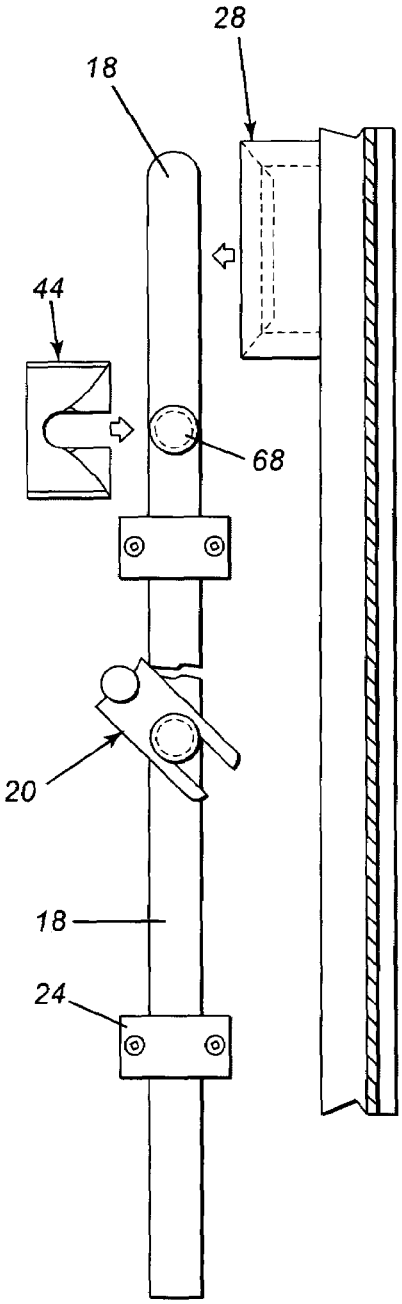
FIGS. 12 to 14 illustrate the interaction of the keeper and cam roller having the adaptor of the present invention during locking of the window.
Figure 13:
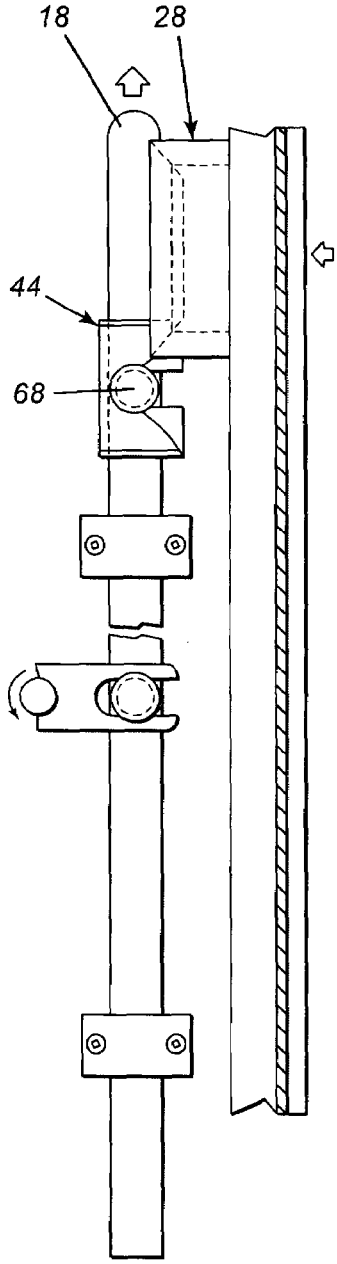

In use, adaptor 44 is placed on cam roller 26 as illustrated in FIG. 12. Thus, cam roller 26 fits within slot 60 while clamps 62 engage slider 18.

Upon actuation of locking handle 20 and pivot bar 22, slider 18 moves in the direction as indicated by arrow 64. This causes ramped portion 32 of keeper 28 to engage with ramped wall portion 50 of first body section 46 on adaptor 44. This allows for a greater reach.

Figure 14:
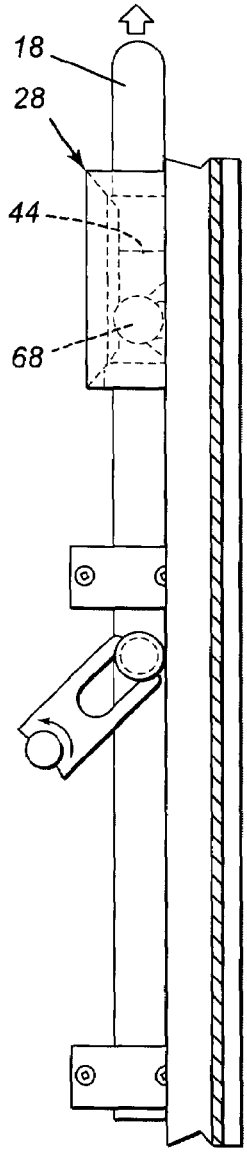
Figure 15:
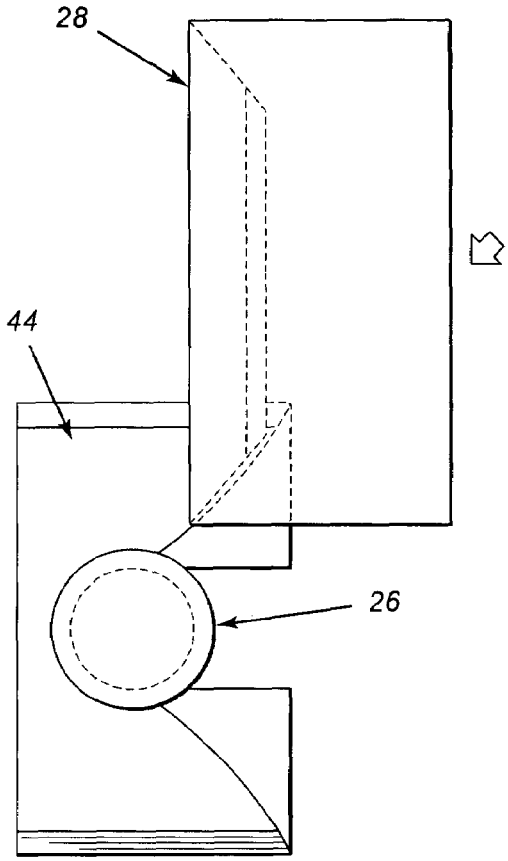
FIGS. 15 and 16 are elevational views illustrating in further detail the locking action of the keeper, cam roller and adaptor of the present invention.
Figure 16:
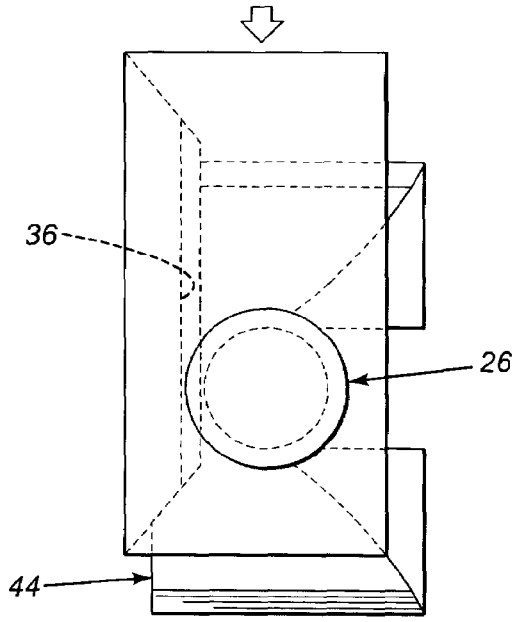
Figure 17:
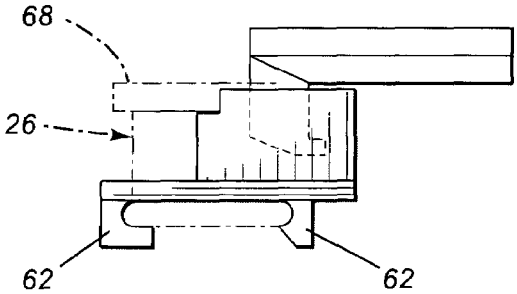
FIGS. 17 and 18 are end elevational views of FIGS. 15 and 16 respectively.
Figure 18:
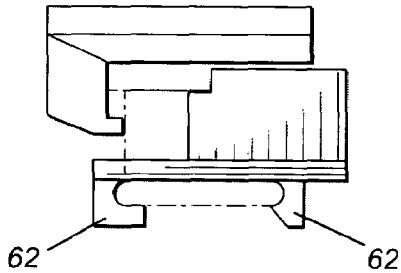

As will be seen in FIG. 14, in the final locked position, flat rest portion 36 of keeper 28 rests against cam roller 26.

Preferably, and as shown in the drawings, ramped wall portions 50 and 56 are somewhat concave in configuration to minimize frictional contact between the two ramped portions. Also, it will be noted that approximately 50% of the cam roller extends exteriorly of slot 60 such that after the ramped portion assists keeper 28 to move along ramped portion 50, the remainder of the movement is about cam roller 26.

It will be understood that the above described embodiment is for purposes of illustration only and that changes and modifications may be made to without departing from the spirit and scope of the invention.

I claim:

1. A retrofit adaptor for use wit an existing window locking mechanism wherein the locking mechanism comprises a keeper on a window sash and a cam roller on a window frame, the adaptor comprising a body portion having first and second sides, a front face and a rear face, a recess formed in said body portion, said recess being sized to receive a portion of said cam roller, said body portion having first and second ramp portions, said first ramp portion extending from an edge of said recess to said first side, said second ramp portion extending from said recess to said second side, each of said first and second ramp portions being of a concave configuration, said rear face having a groove therein for mounting on a slider of said window frame.

2. The adaptor of claim 1 wherein said recess is sized to receive about 50% of the diameter of said cam roller.

3. The adaptor of claim 1 wherein said body portion has a notch formed adjacent said recess to receive a head of a cam roller.

4. In a window having a window locking mechanism comprising a keeper on the window sash, a cam roller and a slider on the window frame, the improvement comprising an adaptor for said cam roller, the adaptor comprising a body, a recess formed in said body, said recess being sized to partially receive said cam roller with a portion of said cam roller extending outwardly from said recess, said body having at least one ramped portion obliquely positioned with respect to a translation direction of the slider, said adaptor being mounted on said slider.

5. The improvement of claim 4 wherein about 50% of said cam roller extends outwardly from said recess.

6. The improvement of claim 4 wherein said body has first and second ramped portions obliquely positioned with respect to a translation direction of the slider.

7. The improvement of claim 6 wherein said ramped portions are concave in configuration.

8. The improvement of claim 4 wherein said keeper has a trapezoidal configuration.

9. The improvement of claim 4 wherein said cam roller is a cylindrical member having an enlarged head portion.

10. The improvement of claim 9 further including a notch portion in said body, said notch portion being arranged to partially receive said enlarged head portion of said cam roller.

* * * * *